US006106382A

United States Patent [19]

Sakaguchi

[11] Patent Number: 6,106,382

[45] Date of Patent: Aug. 22, 2000

[54] ABRASIVE PRODUCT FOR DRESSING

[75] Inventor: Masayuki Sakaguchi, Sagamihara, Japan

[73] Assignee: 3M Innovative Properties Company, St. Paul, Minn.

[21] Appl. No.: 08/876,350

[22] Filed: Jun. 26, 1997

[30] Foreign Application Priority Data

Jun. 27, 1996 [JP] Japan ..... 8-167797

[51] Int. Cl.[7] ..... B24B 21/18; B24B 33/00; B24B 47/26; B24B 55/00

[52] U.S. Cl. ..... 451/443; 451/56

[58] Field of Search ..... 51/296, 295, 308, 51/293, 309, 307, 297; 451/443, 56, 28, 526, 539, 530, 556, 540; 428/209, 210

[56] References Cited

U.S. PATENT DOCUMENTS 5,389,119 2/1995 Ferronato et al. ..... 51/295

FOREIGN PATENT DOCUMENTS 0 013 486 B1 8/1983 European Pat. Off. ..... B24D 11/00
0 276 946 B1 4/1993 European Pat. Off. ..... B24D 11/00
63-77665 4/1988 Japan ..... B24D 11/00
64-2865 1/1989 Japan ..... B24B 53/10
1511098 A1 9/1989 U.S.S.R. ..... B24D 11/00
1516325 A1 10/1989 U.S.S.R. ..... B24B 53/00
WO 93/02837 2/1993 WIPO ..... B24D 3/00

OTHER PUBLICATIONS

"3M Diapad™ Hand Laps" Brochure, 1990.
"3M Flexible Diamond Belts" Brochure, 1992.
"3M Roloc™ Flexible Diamond Discs" Brochure.

*Primary Examiner*—Derris H. Banks
*Attorney, Agent, or Firm*—Daniel R. Pastirik

[57] ABSTRACT

The present invention encompasses an abrasive dressing product suitable for use under wet conditions. The abrasive product includes a rigid backing that includes an electrically conductive layer and a plurality of metallic elements arranged on the backing in a plurality of rows. Each metallic element has an attachment end in contact with the electrically conductive layer and a distal end that contains abrasive particles. Adjacent metallic elements in the same row are spaced apart by a gap which is less than the width of any adjacent metallic element in any adjacent row and individual metallic elements in one row are positioned to overlap the gap between adjacent metallic elements in any adjacent row.

7 Claims, 2 Drawing Sheets

ABRASIVE PRODUCT FOR DRESSING

BACKGROUND OF THE INVENTION

The present invention generally relates to an abrasive product for industrial use and particularly relates to an abrasive product used for dressing.

A typical abrasive product comprises abrasive grains, a backing for supporting the abrasive grains, and a bonding agent for bonding the abrasive grains to the backing. Abrasive ability of these products typically deteriorates during use, due to the wear or separation of abrasive grains. An abrasive product whose abrasive ability has deteriorated can be reused through a so-called "dressing" wherein the abrasive grains necessary for the grinding operation are exposed again. The abrasive product according to the present invention is used for the dressing of such deteriorated abrasive products and is particularly used for dressing a roll-shaped unwoven or woven fabric abrasive brush.

For example, in the metallurgical industry, a roller brush maybe used for the removal of oxide scale from the surface of a rolled metal sheet, wherein the brush has alumina abrasive grains bonded to a roll-shaped backing of non-woven fabric. Although the removal of oxide scale from the surface of a rolled metal sheet lasts for a long time by using the roller brush, the abrasive grains in the brush are pulled out and drop or fall off the roller brush and cause fibers in the non-woven backing to be exposed on the roller surface. The roller brush, which the abrasive ability has thus deteriorated, is subjected to dressing by using known abrasive products such as abrasive products coated with alumina.

Further, where dressing of an abrasive product having grains bonded to fibers in a non-woven backing, it is recommended that the dressing be carried out under dry conditions because defuzzing by burning is preferably carried out after the dressing. However, the removal of oxide scale from the rolled metal sheet surface or the polishing of a copper foil surface on a circuit board is actually carried out under wet condition using water, and it is preferred that dressing is also carried out in a wet condition.

An object of the present invention is to provide an abrasive dressing product well suitable for dressing abrasive articles, such as roller brushes, under wet conditions.

SUMMARY OF THE INVENTION

An abrasive product according to the present invention comprises:

(a) a rigid backing including a major surface, an axis defining a grinding direction and an electrically conductive layer; and (b) a plurality of metallic elements arranged on the major surface in a plurality of rows, each row extending transverse to the grinding direction, each metallic element having an attachment end in contact with the electrically conductive layer and a distal end containing abrasive particles, wherein adjacent metallic elements in the same row are spaced apart by a gap which is less than the width of any adjacent metallic element in any adjacent row and individual metallic elements in one row are positioned to overlap the gap between adjacent metallic elements in any adjacent row.

The electrically conductive layer in the abrasive product of the present invention is required to be electrically conductive for manufacture of the abrasive product, as discussed below. The electrically conductive layer is typically made up of a metal. The layer may also be made of any material other than metals, providing the material has both an appropriate electrical conductivity and an appropriate thermal conductivity as well as the ability to fix metallic elements such as pellets.

In one embodiment, the electrically conductive layer of the abrasive product of this invention is made of a foil or plate-like metallic layer. Thus, the abrasive product in this embodiment of the invention has a foil- or plate-like metallic layer provided on a rigid backing and has metallic pellets containing abrasive grains on the upper surfaces of the pellets. The pellets are arranged to form a plurality of parallel rows extending transverse to the grinding direction on the foil- or plate-like metallic layer so that each of the pellets in each one of the rows is located between every adjacent two pellets in the preceding row and both side portions of the pellet in the one row overlap with the two pellets in the preceding row as seen in the grinding direction, whereby a zigzag arrangement of pellets is obtained. Although the electrically conductive layer provided on the major surface of the backing is hereinafter described as a metallic layer, the electrically conductive layer is, of course, not limited to a metallic layer. Likewise, although the metallic elements located on the conductive layer is hereinafter described as pellets, the metallic elements are, of course, not limited to pellets.

DETAILED DESCRIPTION

Figure 1:
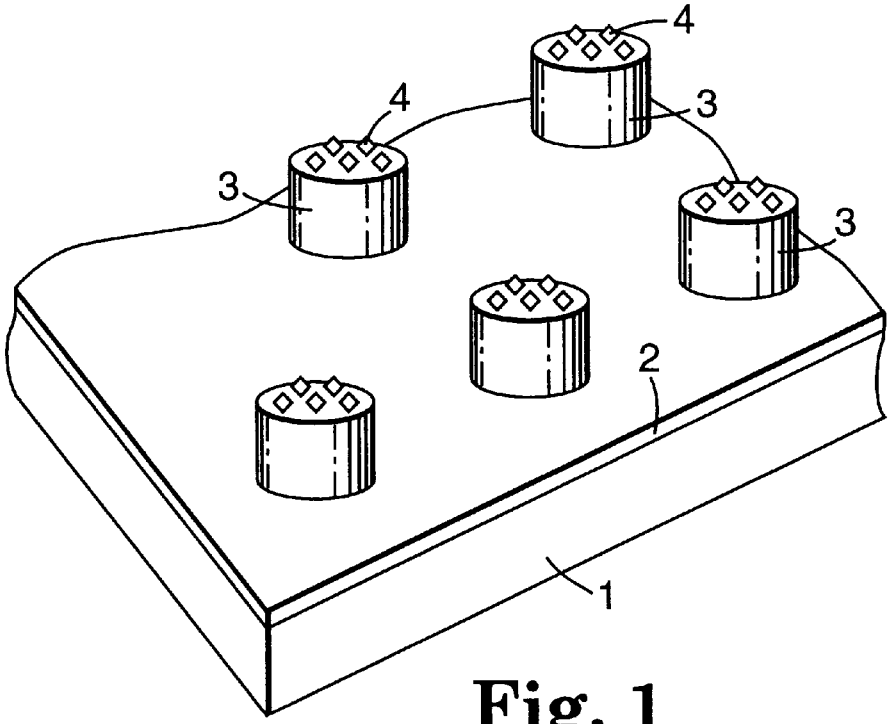
FIG. 1 is a perspective view of part of an abrasive product according to the present invention.

As shown in FIG. 1, an abrasive dressing product according to the present invention is formed by a rigid backing 1, a foil- or plate-like metallic layer 2 located on the backing, a plurality of metallic pellets 3 arranged on the metallic layer, and abrasive grains 4 fixed on the metallic pellet.

The backing 1 may be made of any rigid material, provided that it is a material capable of fixedly carrying the foil- or plate-like metallic layer thereon, i.e., a material capable of maintaining the flatness of the metallic layer during use of the abrasive dressing product of the invention. Sufficient flatness ensures a proper abrading plane formed by the layer of abrasive grains on the top surface of the respective pellets on the metallic layer. Specifically, "rigid" describes a physical property characterized by flexural rigidity, EI, wherein E is modulus of longitudinal elasticity, and I is sectional second-order modulus. As used in this application, "rigid" means the flexural rigidity, EI, of a material is not less than 10 kg/cm$^2$ at the flexure of a sample 10 centimeters wide in its longitudinal direction (the direction perpendicular to the width of the sample). For example, metallic plates, synthetic resin plates such as glass-filled epoxy plate (e.g., FR4 (NEMA part 2 standard), available from Taylor-Fibre), or various composite plates may be used. Also the configuration of the backing 1 may be optional, and suitably selected in accordance with the uses of the present abrasive dressing product. A thickness of the backing 1 may also be suitably selected in accordance with these uses. The flatness of the backing permits the pellets having the abrasive grains disposed on the backing surface through the metallic layer to be strongly fixed in place, to thereby prevent wobble of the abrasive grains during use, which effects abrasive properties, and consequently, provides desired cutting properties of the abrasive grains.

The metallic layer 2 on the backing 1 may be readily formed by adhering a suitable metal foil or sheet to the backing. A preferable metallic layer is a copper foil having a thickness of 18 μm, 35 μm or the like, a copper plate having a thickness of 0.2 mm or more, or similar copper alloys. It is more preferred to use a foil of rolled copper rather than electrolytic copper, due to the mechanical strength of the foil. Brass, bronze or other copper alloys may also be used. The metallic layer 2 facilitates the manufacture of the abrasive dressing product (for example, the metallic pellets can be easily bonded to the backing), and effectively dissipates heat generated during the dressing process. In this respect, the metallic layer in the present invention can more easily dissipate frictional heat generated during use compared with an abrasive product formed by plating a mesh backing with a metal, as disclosed in, for example, U.S. Pat. No. 5,389,119. Adequate heat dissipations provide longer lifetime of the product. Preferably, the metallic layer is thick enough to prevent cracking of the metallic layer in the exposed area between the pellets. The metallic layer may be either equal to or smaller than the size of the backing 1 so that at least part of the backing is covered.

The metallic pellet 3 provided on the metallic layer 2 is preferably made of nickel or nickel alloy. A cross-section of the pellet 3 may be circular or rectangular. The height of the pellet 3 may be varied but is generally in a range between 0.1 mm and 5 mm, preferably between 0.5 mm and 2.0 mm. The width (or diameter) of the pellet 3 may be in a range between 0.5 mm and 1.2 mm. Other dimensions and configurations of the pellet may be properly selected by those skilled in the art.

Figure 2:
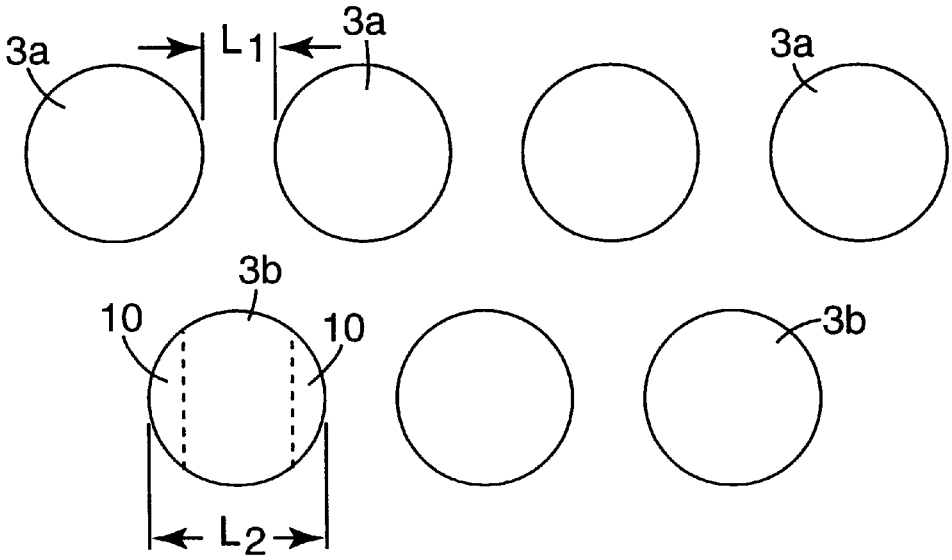
FIG. 2 is an illustration for explaining the overlapped zigzag arrangement of metallic pellets.

It is important that the metallic pellets 3 are arranged on the metallic layer 2 in a zigzag manner in order to form a plurality of parallel rows extending transverse to the grinding direction as shown in FIG. 2, so that each of the pellets 3*b* in one row is located between the adjacent two pellets 3*a* in the preceding row and the opposite side portions 10 of the pellet 3*b* in the one row are overlapped with the two pellets 3*a* in the preceding row as seen in the grinding direction. This relationship may be represented in such a manner that a gap $L_1$ between the adjacent two pellets 3*a* in the preceding row is smaller than a diameter $L_2$ of the pellet 3*b* in the one row, that is, $L_1$ is less than $L_2$.

Figure 3:
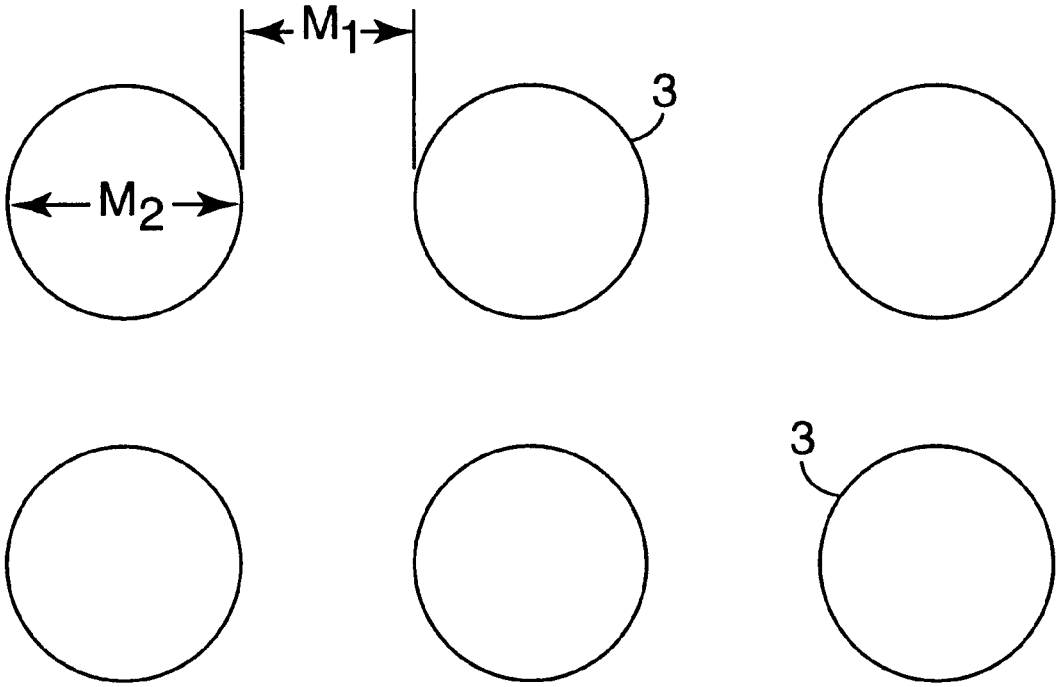
FIG. 3 is an illustration for explaining the matrix arrangement of metallic pellets.

When a soft or semi-hard article is dressed, the surface of such an article is liable to flex due to a load applied during the dressing process. If the pellets 3 are not arranged in an overlapped zigzag manner as shown in FIG. 2 but arranged in a matrix manner in the grinding direction as shown in FIG. 3, material, particularly abrasive material from the article being dressed, is liable to enter gaps between the pellets and will be in direct contact with the metallic layer 2. This leads to wear and may generate cracks in the metallic layer reaching to backing. Such wear may result in the separation of pellets which makes the abrasive dressing product unusable. When the metallic pellets 3 are arranged in a zigzag manner so that each of the pellets is partially overlapped with the other material from the article being dressed is effectively prevented from entering the gap between pellets and the lifetime of the abrasive dressing product may be prolonged to a greater extent.

The abrasive grain 4 on the metallic pellet 3 may be selected in accordance with the types of articles to be dressed. In general, abrasive grains of diamond or cubic boron nitride (CBN) having a high hardness are preferred. The abrasive grains may be of varying sizes. In general, abrasive grains having a size of 5 to 500 micrometers are preferred.

The present abrasive dressing product is easily manufactured by a method disclosed in Japanese Patent Publication (Kokai) No. 63-77665. For example, an abrasive dressing product having a copper foil metallic layer 2 on which pellets 3 made of nickel are arranged, and diamond abrasive grains 4 are bonded to the upper surface of the pellet 3, is made by the following procedure.

First, the copper foil is adhered onto a rigid backing. Then, a screen having apertures formed corresponding to the arrangement of the nickel pellets is layered on the copper foil. The backing covered with the screen is horizontally placed in a lower area of a suitable nickel plating bath (generally an aqueous solution of nickel sulfate, nickel chloride or boric acid), and the copper foil on the backing is connected to a direct current source. A nickel anode connected to the direct current source is arranged above the backing in the plating bath. The electrolytic plating is begun by flowing direct current through the plating bath. While depositing nickel pellets on the copper foil in a predetermined arrangement, diamond abrasive grains are dropped into the plating bath so that the abrasive grains are fixed to the upper surface of the nickel pellets.

EXAMPLES

Various abrasive products were prepared in the above-described manner while using a backing of a glass-epoxy sheet (product number FR4 (NEMA standard), obtained from Taylor-Fibre) for a printed circuit board, abrasive grains of artificial diamond having an average grain size of 250 micrometers, a metallic layer of a rolled copper metal foil (35 μm thick), a copper alloy (brass) foil (35 μm thick) and a copper metal foil (0.5 mm thick), and metallic pellets of nickel (each having a diameter of 0.8 mm and a height of 1.2 mm) arranged in a zigzag manner as shown in FIG. 2 and in a matrix manner as shown in FIG. 3. The metallic layer was adhered to the backing with an epoxy resin. Dressing properties were determined using the following tests.

The tests were carried out in such a way that an article in a form of a non-woven abrasive roll (300 mm diameter×50 mm long) having alumina grains bonded to nylon 66 fibers is dressed under wet conditions while rotating on a flat abrasive dressing product having an effective abrasive surface (which corresponds to a size of the metallic layer on which the pellets having the diamond grains exist) of 100 mm×100 mm. Life span of the product, dressing speed, and pellet-separation were determined. The life span was measured as a time period until the backing layer is exposed by the growth of cracks occurring in the metallic layer between the pellets. The dressing speed was measured as a time period required for cutting off fibers from the surface of the non-woven abrasive roll by 500 micrometers and exposing fresh abrasive grains. The pellet-separation time is measured as a time period from the initiation of the test to an instant at which the pellet is initially separated from the metallic layer, while continuing the test even after the exposure of the backing due to cracking of the metallic layer between the pellets.

For purposes of comparison, the same tests were carried out on an abrasive product wherein abrasive grains of alumina are bonded directly to a resinous backing without a metallic layer (#36 resin cloth, manufactured by 3M; Sample No. 13) and an abrasive product wherein diamond abrasive grains are bonded with a metal bonding agent (Flexible Diamond Metal Bond (250 micrometer), manufactured by Sumitomo 3M; Sample No. 14). The #36 resin cloth of Sample No. 13 is an abrasive article using a flexible backing made up of a cotton-mixed knitting. The Flexible Diamond Metal Bond of Sample No. 14 is an abrasive article using a similar flexible backing made up of a polyester knitting.

The test results are shown in Table 1. In Table 1, a degree of overlap between pellets is represented in a zigzag arrangement shown in FIG. 2 by a ratio between a gap $L_1$ between the adjacent pellets in the row and a diameter $L_2$ of the pellet, and in a matrix arrangement shown in FIG. 3 by a gap $M_1$ between the adjacent pellets and a diameter $M_2$ of the pellet.

TABLE 1

| Sample | Metallic Layer | | Pellet | | Cutting Property Dressing Speed | Lifetime Properties Product Life Span | Lifetime Properties Pellet-Separation Time |
|---|---|---|---|---|---|---|---|
| No. | Material | Thickness | Arrangement | Overlap Degree | (second) | (hour) | (hour) |
| 1 | Cu metal | 35 μm | zigzag | $L_1/L_2$ = 0.2 to 0.6 | <150 | ≧20 | ≧50 |
| 2 | Cu metal | 35 μm | zigzag | $L_1/L_2$ = 0.7 to 1.0 | <150 | ≧10 | ≧30 |
| 3 | Cu metal | 35 μm | zigzag | $L_1/L_2$ = 1.5 to 3.0 | <150 | 0.5 to 1.0 | ≧10 |
| 4 | Cu metal | 35 μm | matrix | $M_1 = M_2$ = 0.7 mm | <150 | 0.5 to 1.0 | ≧10 |
| 5 | Cu alloy | 35 μm | zigzag | $L_1/L_2$ = 0.2 to 0.6 | <150 | ≧50 | ≧100 |
| 6 | Cu alloy | 35 μm | zigzag | $L_1/L_2$ = 0.7 to 1.0 | <150 | ≧35 | ≧50 |
| 7 | Cu alloy | 35 μm | zigzag | $L_1/L_2$ = 1.5 to 3.0 | <150 | ≧20 | ≧50 |
| 8 | Cu alloy | 35 μm | matrix | $M_1 = M_2$ = 0.7 mm | <150 | ≧5 | ≧10 |
| 9 | Cu metal | 0.5 μm | zigzag | $L_1/L_2$ = 0.2 to 0.6 | <150 | ≧200 | ≧500 |
| 10 | Cu metal | 0.5 μm | zigzag | $L_1/L_2$ = 0.7 to 1.0 | <150 | ≧150 | ≧300 |
| 11 | Cu metal | 0.5 μm | zigzag | $L_1/L_2$ = 1.5 to 3.0 | <150 | ≧100 | ≧200 |
| 12 | Cu metal | 0.5 μm | matrix | $M_1 = M_2$ = 0.7 mm | <150 | ≧100 | ≧200 |
| 13 | *1 | | | | >900 | 5 min | — |
| 14 | *2 | | zigzag | $L_1/L_2$ = 0.2 to 0.6 | >300 | ≧3 | ≧5 |

*1 #36 Resin Cloth, backing of cotton-mixed knitting.
*2 Flexible Diamond Metal Bond #250M21, backing of polyester knitting.
Sample Nos. 1–12 used, as the backing, a glass-epoxy plate for printed circuit board.

As apparent from the above results, disposing the metallic pellets carrying the abrasive grains thereon on the rigid backing through the metallic layer allows the abrasive grains to be strongly fixed to the backing which improves the cutting properties of the abrasive product. As a result, a sufficient dressing rate can be ensured in, for example, the dressing of a roller brush. Further, arranging the pellets in a zigzag manner so as to overlap them with each other in the grinding direction can provide abrasive products having a markedly improved lifetime compared to known products (Sample Nos. 13 and 14). The effect of overlapped zigzag arrangement of pellets is particularly marked in cases where the metallic layer has a smaller thickness (see Sample Nos. 1 to 4 and 9 to 12). The effect of zigzag arrangement of pellets is observed regardless of thickness of metallic layer. If the thickness of the metallic layer is fixed, a material having a greater mechanical strength is more advantageous. For example, if copper metal and copper alloy are compared with each other, the former has a greater mechanical strength.

The present abrasive dressing products are well suitable for the dressing under wet conditions, particularly dressing a roll-shaped unwoven or woven fabric abrasive brush.

What is claimed is:

1. An abrasive product suitable for dressing a roll-shaped unwoven or woven fabric abrasive brush, comprising:

(a) a rigid backing having a major surface, (b) an electrically conductive metallic foil or sheet adhered to the major surface of the backing; and (c) a plurality of metallic elements, each metallic element having a width and having an attachment end in contact with the electrically conductive layer and a distal end having abrasive particles affixed thereto, the metallic elements arranged in a plurality of rows with adjacent metallic elements within a row spaced apart by a gap less than the width of an adjacent metallic element in an adjacent row and each metallic element in the same row positioned to overlap the gap between adjacent metallic elements in an adjacent row.

2. An abrasive product as defined by claim 1, wherein the electrically conductive layer consists of copper or copper alloy.

3. An abrasive product as defined by claim 2, wherein the electrically conductive layer consists of a plate having a thickness of 0.2 mm or more.

4. An abrasive product as defined by claim 1, wherein the metallic elements comprise a material selected from nickel or nickel alloy.

5. An abrasive product as defined by claim 4, wherein the metallic elements are circular in cross section.

6. An abrasive product as defined by claim 4, wherein the metallic elements are rectangular in cross section.

7. An abrasive product as defined by claim 4, wherein the abrasive grain is selected from diamond or cubic boron nitride.

* * * * *

UNITED STATES PATENT AND TRADEMARK OFFICE

CERTIFICATE OF CORRECTION

PATENT NO. : 6,106,382
DATED : August 22, 2000
INVENTOR(S) : Masayuki Sakaguchi

It is certified that error appears in the above-identified patent and that said Letters Patent is hereby corrected as shown below:

Column 4,
Line 37, "100 mm" should read --75 mm --.

Signed and Sealed this

Twenty-ninth Day of January, 2002

*Attest:*

*Attesting Officer*

JAMES E. ROGAN
*Director of the United States Patent and Trademark Office*